US006957614B1

(12) United States Patent
Buck

(10) Patent No.: US 6,957,614 B1
(45) Date of Patent: Oct. 25, 2005

(54) SYSTEM, APPARATUS, AND METHOD FOR INTEGRATING SCREEN PRINTING AND EMBROIDERY ON A GARMENT WHILE MOUNTED IN A SINGLE HOOP

(76) Inventor: James Buck, 6701 Chelsea Ct., Fort Worth, TX (US) 76132

( * ) Notice: Subject to any disclaimer, the term of this patent is extended or adjusted under 35 U.S.C. 154(b) by 0 days.

(21) Appl. No.: 10/840,019

(22) Filed: May 6, 2004

(51) Int. Cl.[7] ..... D05C 9/04
(52) U.S. Cl. ..... 112/103; 101/127.1
(58) Field of Search ..... 112/102.5, 103, 112/119, 475.04, 475.18; 101/127.1

(56) References Cited

U.S. PATENT DOCUMENTS

| | | | | |
|---|---|---|---|---|
| 4,315,461 | A * | 2/1982 | Harpold | 101/115 |
| 4,846,058 | A * | 7/1989 | Farris | 101/123 |
| 5,144,899 | A | 9/1992 | Allen | |
| 5,613,436 | A * | 3/1997 | Taylor | 101/115 |
| 5,842,430 | A * | 12/1998 | Mack | 112/103 |
| 6,832,569 | B2 * | 12/2004 | Krasnitz | 112/475.18 |

OTHER PUBLICATIONS

Richard lebovitz, "Hirsch Shows New Multimedia Technology", EMB (Embroidery/Monogram Business Magazine), Mar. 2004, p. 14, vol. 11, No. 3, VNU Business Publications USA, NY.

* cited by examiner

*Primary Examiner*—John J. Calvert
*Assistant Examiner*—Brian Kauffman
(74) *Attorney, Agent, or Firm*—Bracewell & Giuliani LLP

(57) ABSTRACT

A system, apparatus and method of screen printing and embroidering a workpiece in a single workpiece holder is disclosed. The workpiece is secured in a hoop that is interchangeably mountable to a screen printing machine and an automated embroidery machine. The hoop is mounted in a first hoop sash or holder on the screen printing machine, screen printed, and removed from the first hoop holder. The hoop is then mounted in a second hoop sash or holder on the automated embroidery machine such that the hoop centers and rotationally aligns the workpiece during embroidery without having to remove the workpiece from the hoop between operations.

23 Claims, 5 Drawing Sheets

SYSTEM, APPARATUS, AND METHOD FOR INTEGRATING SCREEN PRINTING AND EMBROIDERY ON A GARMENT WHILE MOUNTED IN A SINGLE HOOP

BACKGROUND OF THE INVENTION

1. Technical Field

The present invention relates in general to an improved system for screen printing and embroidery and, in particular, to an improved system, apparatus, and method for both screen printing and embroidering a garment while it is mounted in a mounting hoop without having to remove the garment from the mounting hoop until both processes are complete.

2. Description of the Related Art

The design and appearance of garments may be enhanced by a number of methods or embellishments, such as silk screening, embroidery, or applique. Traditionally, only one of these methods is used in the design of a garment. However, some mixed-media designs that incorporate more than one method have become popular. Producing such mixed-media designs on garments can present a challenge when attempting to interface the different embellishments.

For example, garments that integrate both a silk screened feature and an embroidery design must be carefully aligned in terms of both centering and rotational alignment to achieve the desired effect. Unfortunately, the prior art systems used to silk screen a garment and those used to embroider the same garment are incompatible. This incompatibility requires the garment to first be silk screened, removed from the silk screen machine, mounted in an embroidery hoop, and then carefully positioned and aligned, by hand, in the embroidery machine before being embroidered. The manual positioning and aligning step is critical for ensuring precise integration between the silk screen feature and the embroidery design. Because of human error, it is also prone to be a significant source of increased costs in the overall process.

There have been several attempts to address this problem. For example, U.S. Pat. No. 5,144,899, to Allen, discloses a combination embroidery and screen printing apparatus and method. This device has an inner hoop that cooperates with an outer hoop for clamping and confining a selected area of a garment as a reproduction of a selected pattern is formed thereon. A framed screen forms a first portion of the reproduction on the garment by screen printing, a stitching machine forms a second portion of the reproduction on the garment by automated stitching, and an alignment template obtains close registration between the printed first portion and the stitched second portion of the reproduction. The framed screen and the alignment template are shaped and dimensioned so that each can be removably inserted in the inner hoop. In addition, a removable target disk is required with the alignment template to align the garment relative to the clamping hoops.

A more recent disclosure (*Hirsch Shows New Multimedia Technology*, eMB, Vol. 11, Iss. 3, March 2004, p. 14) describes a large, thin, flat oval frame that holds a garment during both the screen print and embroidery process. When screen printed, the frame sits in a recess in a platen on the screen printing machine to provide a flat surface for the printing process. When the garment is embroidered, flanges on the frame attach to specifically designed tubular arms on the machine so that no re-hooping is required. Although both of these designs are workable, an improved and more cost-effective system, apparatus, and method for both screen printing and embroidering a garment would be desirable.

SUMMARY OF THE INVENTION

One embodiment of a system, method, and apparatus for screen printing and embroidering a garment mounted in a hoop without having to remove the garment from the hoop until both processes are complete is disclosed. The screen printing machine has a first hoop holder mounted to a frame adjacent to a platen. The workpiece is secured in the hoop and the hoop is releasably mounted in the hoop holder.

An automated embroidery machine has a second hoop holder for interchangeably receiving the hoop, without removing the garment from the hoop. The hoop and hoop holders have registration and alignment features to ensure accurate centering and rotational alignment between the hoop and the screen printing and automatic embroidery machines. With the present invention, an operator is able to support, center, and rotationally align a garment during both screen printing and embroidery without having to remove the garment between operations.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
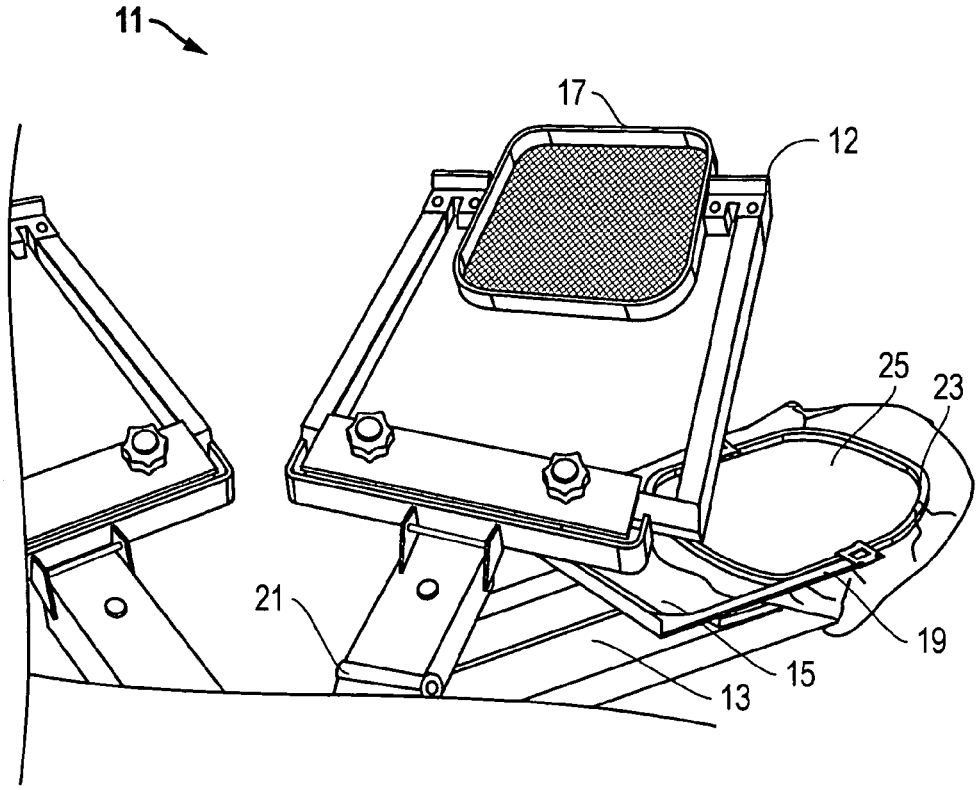
FIG. 1 is a side isometric view of a screen printing machine constructed in accordance with the present invention.
Figure 2:
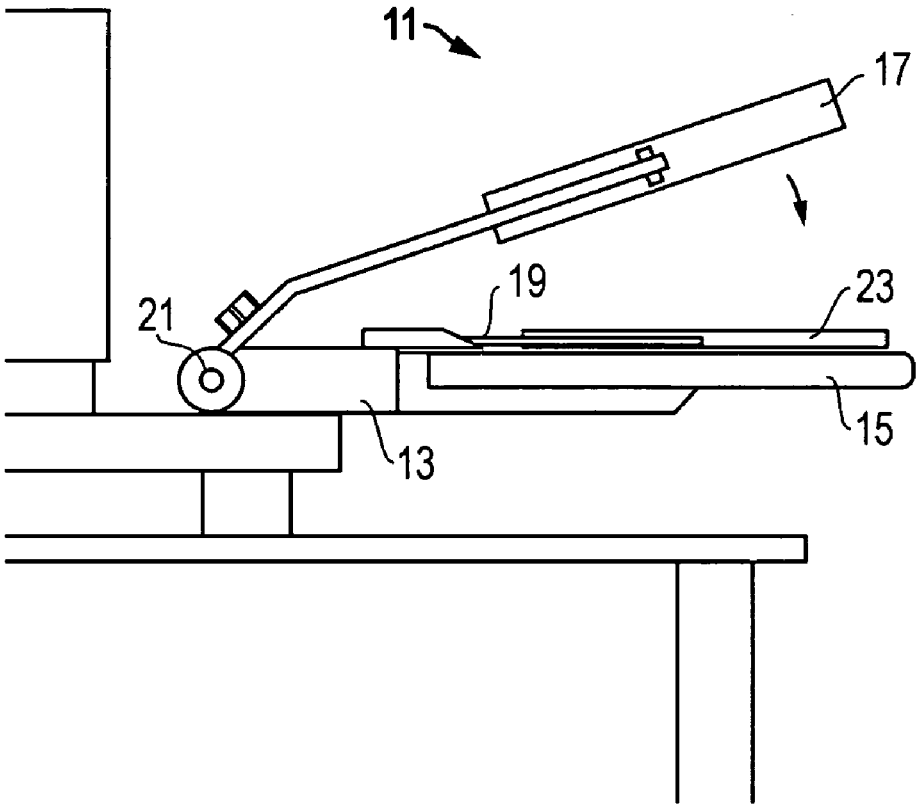
FIG. 2 is a side view of a portion of the screen printing machine of FIG. 1.
Figure 3:
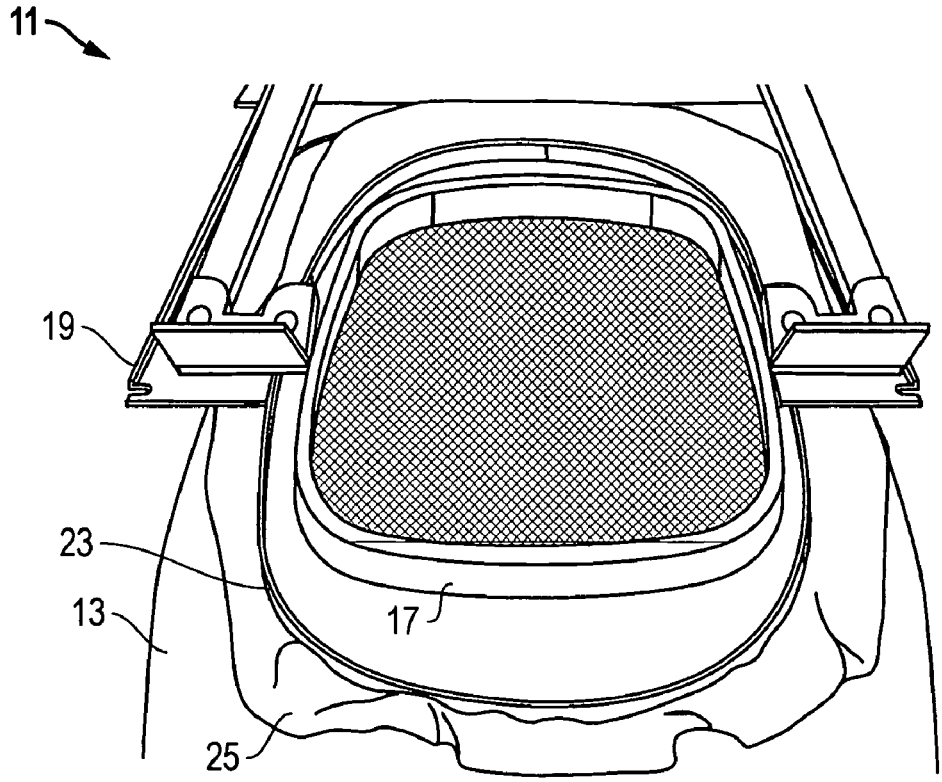
FIG. 3 is a front isometric view of the screen printing machine of FIG. 2.
Figure 5:
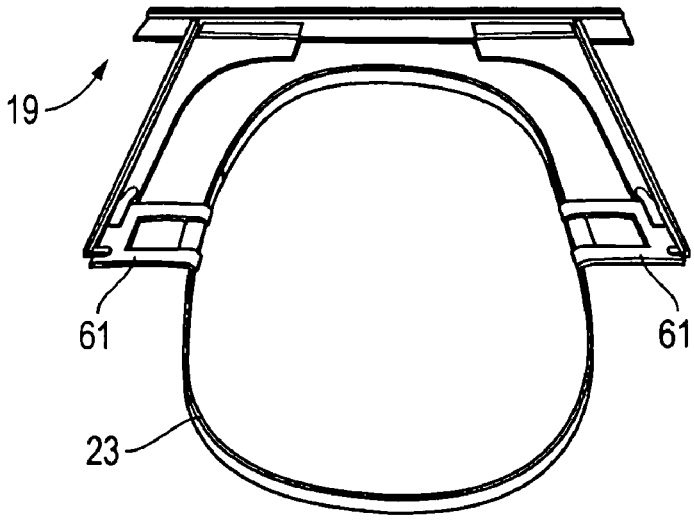
FIG. 5 is an isometric view of one embodiment of a hoop and hoop holder for supporting a workpiece interchangeably on both the screen printing and automated embroidery machines of FIGS. 1–4 and is constructed in accordance with the present invention.

Referring to FIGS. 1–6, one embodiment of an apparatus and system for enabling a workpiece (e.g., a textile substrate such as a garment, etc.) to be both screen printed and embroidered while the garment is mounted in a hoop without having to remove the garment from the hoop until both processes are complete is disclosed.

One component of the system is a screen printing machine 11 (FIGS. 2 and 3) having a frame 13 with at least one printing station 12 and a drying station. Each printing station 12 has a platen 15 mounted to the frame 13, a screen assembly 17 mounted to the frame 13 that is movable relative to the platen 15, and a first hoop holder 19 (e.g., a tubular embroidery hoop holder) mounted to the frame 13 adjacent to but spaced apart from the platen 15. The screen assembly 17 has a pivot 21 for enabling motion relative to the platen 15. In one embodiment, the hoop holder 19 is secured to the frame 13 between the pivot 21 and the platen 15, as shown.

A hoop 23, such as a tubular embroidery hoop, releasably supports a workpiece 25 therein. Typically, a workpiece 25 is securely loaded in the hoop 23 and the hoop 23 is releasably mounted to the hoop holder 19 and platen 15 at the first printing station 12. One printing station 12 is usually required for each color in the screen print design that is being applied to the workpiece 25. The just-screened workpiece 25 is then rotated to the drying station to set the freshly applied design, and then the next color station, if any, is rotated to the platen, and the process is repeated until all of the colors have been applied and dried. In addition, an optional centering feature 28 (FIG. 4) may be screened onto the workpiece 25 during the screen printing process. The centering feature 28 is designed to help the operator center and align the workpiece 25 during a subsequent embroidery step, which will be explained below.

Figure 4:
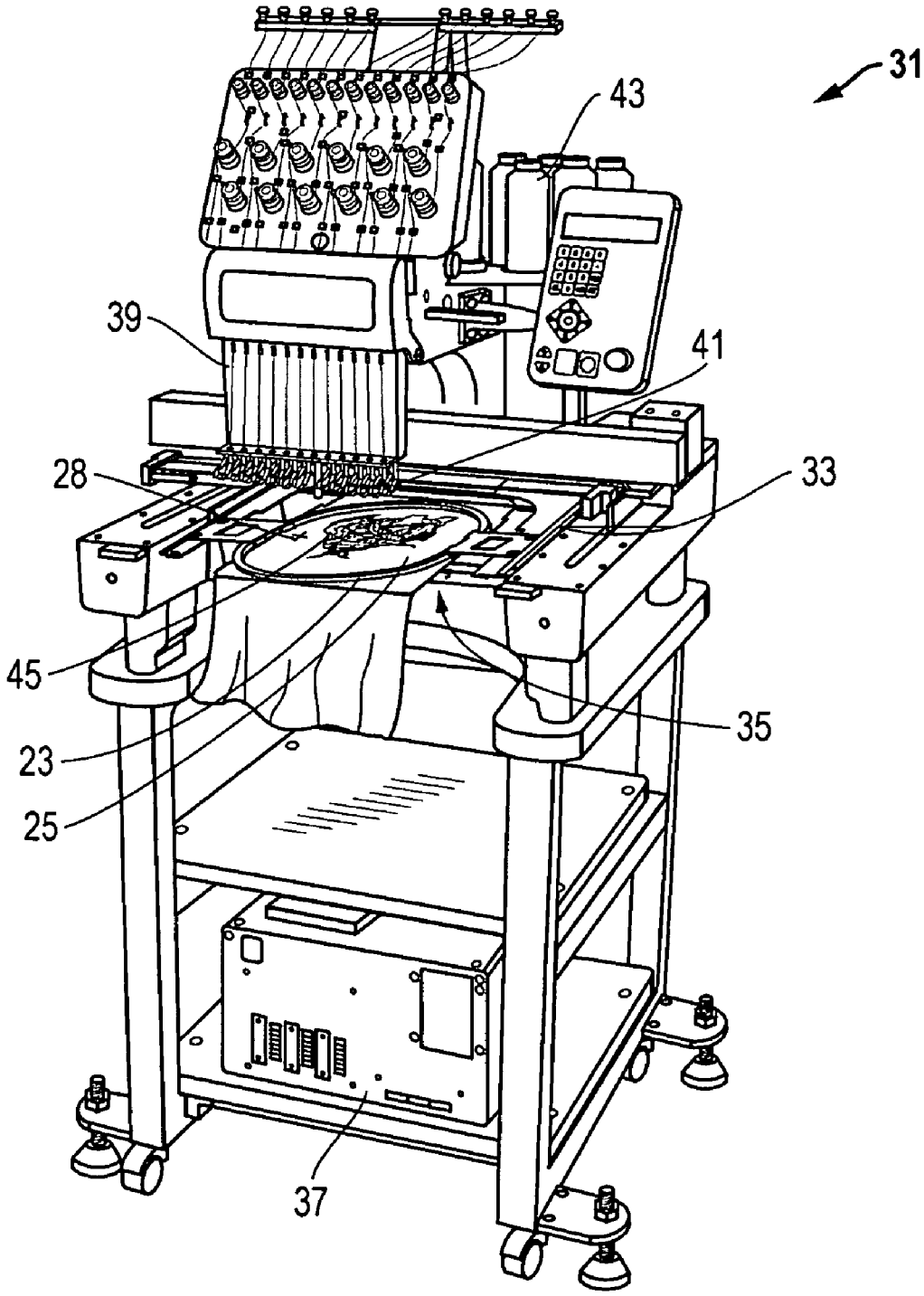
FIG. 4 is an isometric view of an automated embroidery machine constructed in accordance with the present invention.
Figure 6:
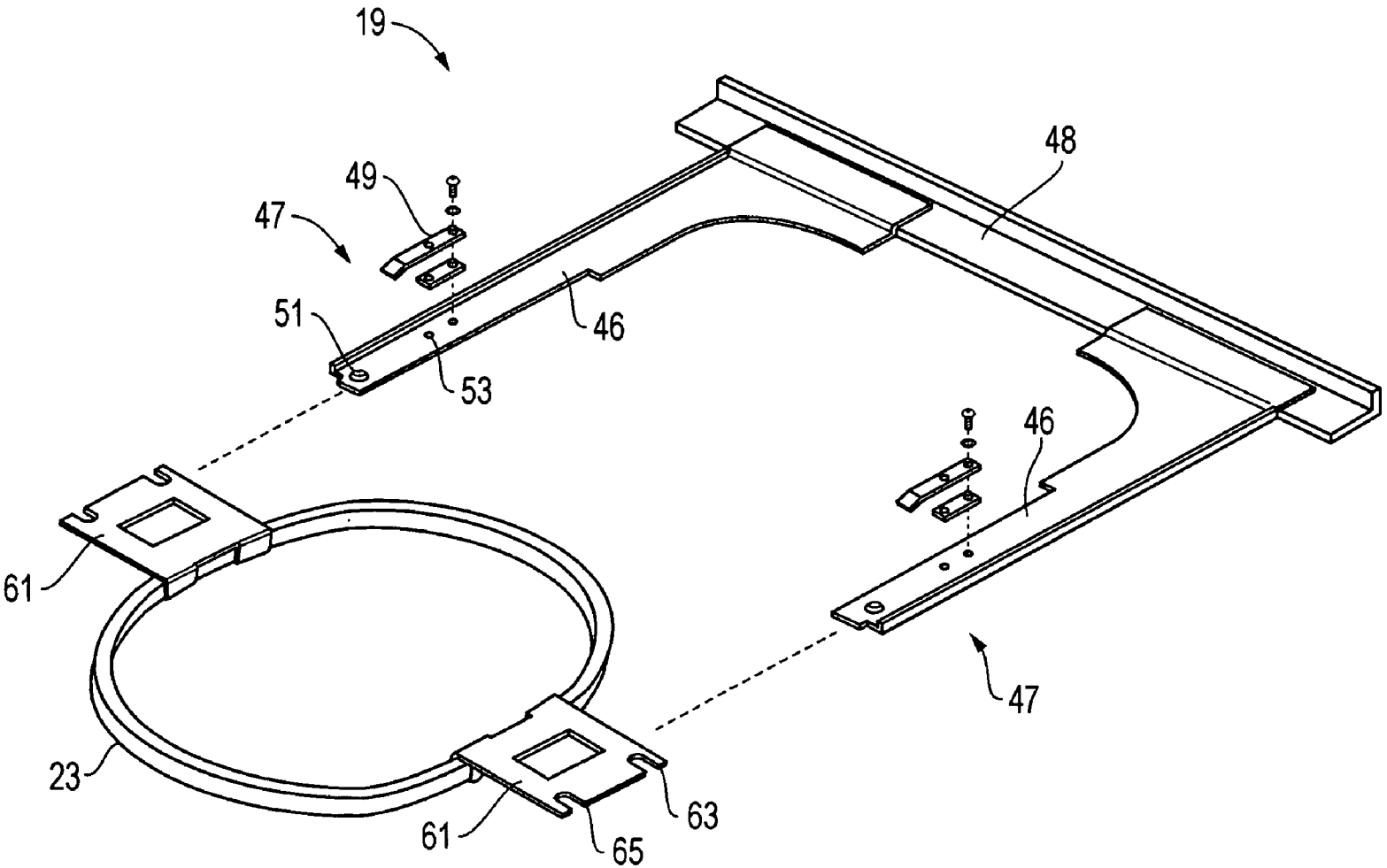
FIG. 6 is an exploded view of the hoop and hoop holder of FIG. 5.

As shown in FIG. 4, the system further comprises an automated embroidery machine 31 having a second hoop holder 33. In one embodiment, the first and second hoop holders 19, 33 are identical. The automatic embroidery machine 31 has a chassis 35, a computer 37 mounted to the chassis 35, and at least one head 39 for performing embroidery functions on the workpiece 25. The head 39 has sewing needles 41 for sewing with different colors of thread 43 and stitching designs 45 on the workpiece 25.

In one embodiment, each tubular hoop holder or sash 19, 33 has two arms 46 (FIGS. 5 and 6) that extend from a base 48. The base 48 mounts to the screen printing machine 11 or automated embroidery machine 31, respectively, such as the frames thereof. In the version shown, each arm 46 has quick-release features 47 that are used to quickly and easily interchangeably engage/release the hoop 23. Ideally, the quick-release features 47 do not utilize threaded fasteners. Rather, the quick-release features 47 are designed to snap onto and off of hoop 23 which supports the workpiece 25. For example, the quick-release features 41 of the embodiment shown comprise spring clips 49, registration pins 51, registration sockets 53, and still other types of quick-release feature such as those known in the art. A more thorough description of automated embroidery machines is found in U.S. Pat. No. 6,694,906, which is incorporated herein by reference.

Again referring to FIGS. 5 and 6, one embodiment of the hoop 23 has a pair of arms 61 that interchangeably engage the first or second tubular embroidery hoop holders 19, 33, at their arms 46. The hoop 23 is preferably formed from a metallic material so that it can withstand the high temperatures required during the screen printing drying phase. The respective arms 46 of the first and second embroidery hoop holders 19, 33 are adjustable in a width direction (e.g., along base 48) to accommodate hoops and workpieces of various sizes.

Like arms 46 of hoop holders 19, 33, the arms 61 of the hoop 23 are provided with complementary registration and alignment features 63, 65 to ensure accurate centering and rotational alignment between the hoop 23 and the screen printing and automatic embroidery machines 11, 31. As described above, the optional centering feature 28 is screened on the workpiece 25 during screen printing to help the operator center and align the workpiece 25 with a needle 41 of the automated embroidery machine 31. The centering feature 28 is strategically placed on the workpiece 25 such that it is embroidered over and, thus, not visible after the embroidery step is complete. The hoop 23 enables the operator to support, center, and rotationally align the workpiece 25 during both screen printing and embroidery without having to remove the workpiece 25 from the hoop 23 between operations.

The present invention also comprises a method of screen printing and embroidering a workpiece. In one embodiment, the method comprises securing a workpiece 25 in a hoop 23 that is interchangeably mountable to a screen printing machine 11 and an automated embroidery machine 31. The method further comprises mounting the hoop 23 in a first hoop holder 19 on the screen printing machine 11, screen printing on the workpiece 25, and removing the hoop 23 from the first hoop holder 19. The method also comprises mounting the hoop 23 in a second hoop holder 33 on the automated embroidery machine 31, such that the hoop 23 centers and rotationally aligns the workpiece 25 during embroidery without having to remove the workpiece 25 from the hoop 23 between operations.

The method may still further comprise providing identical first and second hoop holders 19, 33, and/or interchangeably engaging the first and second hoop holders 19, 33 with a pair of opposed arms 61 on the hoop 23. Additionally, the arms 61 of the hoop 23 may be adjusted in a width direction to accommodate workpieces of various sizes. The method may further comprise centering and rotationally aligning the hoop 23 and the screen printing and automatic embroidery machines 11, 31 with registration and alignment features 47, 63, 65 on the arms 61, 46 of the hoop 23 and the first and second hoop holders 19, 33, respectively.

The method optionally comprises screening a centering feature 28 on the workpiece 25, and further comprises aligning the centering feature 28 with respect to a needle 41 of the automated embroidery machine 31. The method may further comprise providing the screen printing machine 11 with a frame 13, a platen 15 mounted to the frame 13, a screen assembly 17 mounted to the frame 13 that is movable relative to the platen 15, and positioning the first hoop holder 19 adjacent to but spaced apart from the platen 15. In addition, the method may comprise providing the screen assembly with a pivot 21 for enabling motion relative to the platen 15, and securing the first hoop holder 19 to the frame 13 between the pivot 21 and the platen 15.

While the invention has been shown or described in only some of its forms, it should be apparent to those skilled in the art that it is not so limited, but is susceptible to various changes without departing from the scope of the invention.

What is claimed is:

1. A system for both screen printing and embroidering a workpiece, comprising:

a screen printing machine having a first hoop holder;

an automated embroidery machine having a second hoop holder;

a hoop that interchangeably engages the first or second hoop holders, such that the hoop supports, centers, and rotationally aligns a workpiece during both screen printing and embroidery without having to remove the workpiece from the hoop between operations; and the first and second hoop holders being adjustable in a width direction to accommodate workpieces and hoops of various sizes.

2. The system of claim 1, wherein the first and second hoop holders are identical.

3. The system of claim 1, wherein the hoop has a pair of opposed arms for interchangeably engaging the first and second hoop holders.

4. The system of claim 3, wherein the arms of the hoop and the first and second hoop holders are provided with registration and alignment features to ensure accurate centering and rotational alignment between the hoop and the screen printing and automatic embroidery machines.

5. The system of claim 1, wherein the hoop is formed from a metallic material to withstand the high temperatures required during a screen printing drying phase.

6. The system of claim 1, wherein a centering feature is screened on the workpiece during screen printing for aligning the workpiece with a needle of the automated embroidery machine.

7. The system of claim 1, wherein the screen printing machine has a frame, a platen mounted to the frame, a screen assembly mounted to the frame that is movable relative to the platen, and the first hoop holder is mounted to the frame adjacent to but spaced apart from the platen.

8. The system of claim 7, wherein the screen assembly has a pivot for enabling motion relative to the platen, and the first hoop holder is secured to the frame between the pivot and the platen.

9. A system for both screen printing and embroidering a textile substrate, comprising:

a screen printing machine having a frame, a platen mounted to the frame, a screen assembly mounted to the frame that is movable relative to the platen, and a first tubular embroidery hoop holder mounted to the frame adjacent to but spaced apart from the platen;

an automated embroidery machine having a second tubular embroidery hoop holder; and a tubular hoop having a pair of arms that interchangeably engage the first or second tubular embroidery hoop holders, such that the tubular hoop supports, centers, and rotationally aligns a textile substrate during both screen printing and embroidery without having to remove the textile substrate from the tubular hoop between operations.

10. The system of claim 9, wherein the first and second tubular embroidery hoop holders are identical.

11. The system of claim 9, wherein the first and second tubular embroidery hoop holders are adjustable in a width direction to accommodate textile substrates and tubular hoops of various sizes.

12. The system of claim 9, wherein the tubular hoop is formed from a metallic material to withstand the high temperatures required during a screen printing drying phase.

13. The system of claim 9, wherein a centering feature is screened on the textile substrate during screen printing for aligning the textile substrate with a needle of the automated embroidery machine.

14. The system of claim 13, wherein the screen assembly has a pivot for enabling motion relative to the platen, and the first tubular embroidery hoop holder is secured to the frame between the pivot and the platen.

15. The system of claim 13, wherein the arms of the tubular hoop and the first and second tubular embroidery hoop holders are provided with registration and alignment features to ensure accurate centering and rotational alignment between the tubular hoop and the screen printing and automatic embroidery machines.

16. A method of screen printing and embroidering a workpiece, comprising:

(a) securing a workpiece in a hoop that is interchangeably mountable to a screen printing machine and an automated embroidery machine; then (b) mounting the hoop in a first hoop holder on the screen printing machine;

(c) screen printing on the workpiece;

(d) removing the hoop from the first hoop holder; and then (e) mounting the hoop in a second hoop holder on the automated embroidery machine, such that the hoop centers and rotationally aligns the workpiece during embroidery without having to remove the workpiece from the hoop between operations.

17. The method of claim 16, wherein steps (b) and (e) further comprise providing identical first and second hoop holders.

18. The method of claim 16, wherein steps (b) and (e) comprise interchangeably engaging the first and second hoop holders with a pair of opposed arms on the hoop.

19. The method of claim 18, further comprising adjusting the first and second hoop holders in a width direction to accommodate workpieces and hoops of various sizes.

20. The method of claim 18, further comprising centering and rotationally aligning the hoop and the screen printing and automatic embroidery machines with registration and alignment features on the arms of the hoop and the first and second hoop holders.

21. The method of claim 16, wherein step (c) comprises screening a centering feature on the workpiece, and step (e) further comprises aligning the centering feature with respect to a needle of the automated embroidery machine.

22. The method of claim 16, further comprising providing the screen printing machine with a frame, a platen mounted to the frame, a screen assembly mounted to the frame that is movable relative to the platen, and positioning the first hoop holder adjacent to but spaced apart from the platen.

23. The method of claim 22, further comprising providing the screen assembly with a pivot for enabling motion relative to the platen, and securing the first hoop holder to the frame between the pivot and the platen.

* * * * *